US011037702B2

(12) United States Patent
Huang et al.

(10) Patent No.: US 11,037,702 B2
(45) Date of Patent: Jun. 15, 2021

(54) HIGH FREQUENCY CABLE COMPRISING A CENTER CONDUCTOR HAVING A FIRST WIRE STRANDED BY PLURAL SECOND WIRES THAT PROVIDE CORNERS FREE OF GAPS

(71) Applicant: Hitachi Metals, Ltd., Tokyo (JP)

(72) Inventors: Detian Huang, Tokyo (JP); Masashi Moriyama, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/448,744

(22) Filed: Jun. 21, 2019

(65) Prior Publication Data

US 2020/0006835 A1 Jan. 2, 2020

(30) Foreign Application Priority Data

Jun. 28, 2018 (JP) ..... JP2018-122821

(51) Int. Cl.

| | |
|---|---|
| ***H01B 11/18*** | (2006.01) |
| ***H01P 3/06*** | (2006.01) |
| ***H01P 11/00*** | (2006.01) |
| ***H01B 5/08*** | (2006.01) |

(52) U.S. Cl.

CPC ..... *H01B 11/1813* (2013.01); *H01B 5/08* (2013.01); *H01B 11/1808* (2013.01); *H01P 3/06* (2013.01); *H01P 11/005* (2013.01)

(58) Field of Classification Search

CPC ..... H01P 3/06; H01P 11/005; H01B 11/18; H01B 11/1813; H01B 5/08; H01B 5/102; H01B 5/107

USPC ..... 333/243

See application file for complete search history.

(56) References Cited

U.S. PATENT DOCUMENTS 1,943,087 A * 1/1934 Potter et al. ..... H01B 13/0214 174/107

3,760,093 A * 9/1973 Pemberton ..... H01B 5/08 174/128.1

FOREIGN PATENT DOCUMENTS

GB 2 137 907 A 10/1984

JP S 61-45512 A 3/1986

* cited by examiner

*Primary Examiner* — Benny T Lee

(74) *Attorney, Agent, or Firm* — McGinn I.P. Law Group, PLLC.

(57) ABSTRACT

A high frequency cable includes a center conductor comprising one first wire, which is located at the center of the center conductor, and a plurality of second wires, which are located around that one first wire, and the one first wire and the plurality of second wires are stranded together. Respective outer peripheral surfaces of the plurality of second wires constitute a substantially continuous circular peripheral surface as an outer peripheral surface of the center conductor.

16 Claims, 4 Drawing Sheets

FIG.2

| Test item | | | Unit | Example | Comparative example |
|---|---|---|---|---|---|
| Electrical properties | Characteristic impedance | | Ω | 50.7 | 49.7 |
| | Conductor resistance (20°C) | Inner | Ω/km | 564 | 600 |
| | | Outer | | 233 | 218 |
| | Electrostatic capacitance(1kHz) | | pF/m | 99.8 | 102.5 |
| | Attenuation (100MHz ~ 40GHz) | 0.1GHz | dB/m | 0.55 | 0.57 |
| | | 0.5GHz | | 1.25 | 1.30 |
| | | 1GHz | | 1.82 | 1.90 |
| | | 2GHz | | 2.68 | 2.78 |
| | | 3GHz | | 3.45 | 3.53 |
| | | 4GHz | | 3.88 | 4.30 |
| | | 5GHz | | 4.55 | 4.85 |
| | | 6GHz | | 5.00 | 5.41 |
| | | 10GHz | | 7.85 | 8.33 |
| | | 20GHz | | 14.02 | 14.81 |
| | | 30GHz | | 20.20 | 25.34 |
| | | 40GHz | | 27.62 | 33.85 |
| Structure / dimensions | Center conductor | Configuration | pcs/mm | 7/0.065~0.070 | 7/0.072~0.073 |
| | | Outer diameter | mm | 0.202 | 0.219 |
| | | Strand | - | Concentric / right-hand | Concentric / right-hand |
| | | Pitch | mm | 8.7 | 2.6 |
| | Insulating layer | Average thickness | mm | 0.209 | 0.199 |
| | | Minimum thickness | mm | 0.201 | 0.195 |
| | | Outer diameter | mm | 0.612~0.615 | 0.618~0.624 |
| | Outer conductor | Wire diameter | mm | 0.050~0.051 | 0.051~0.052 |
| | | Quantity | pcs | 38 | 39 |
| | | Wrap direction | - | Right-hand (spiral wrap) | Right-hand (spiral wrap) |
| | | Pitch | mm | 9.7 | 10.9 |
| | | Outer diameter | mm | 0.716~0.718 | 0.725~0.735 |
| | Sheath layer | Average thickness | mm | 0.060 | 0.055 |
| | | Minimum thickness | mm | 0.058 | 0.052 |
| | | Outer diameter | mm | 0.830~0.834 | 0.837~0.844 |
| | Section photo | | - | 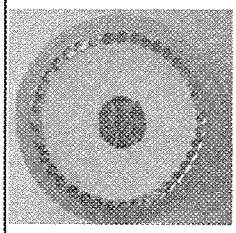 | 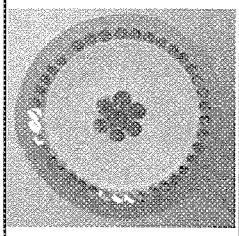 |

*FIG.4*

| | | | Example | Comparative example |
|---|---|---|---|---|
| Center conductor | Compressing step | | Present | Absent |
| | Material | | Ag-plated | Ag-plated |
| | Number of wires | | 7 (stranded wires) | 7 (stranded wires) |
| Insulating layer | Material | | FEP | FEP |
| Outer conductor | Material | | Sn-plated soft copper | Sn-plated soft copper |
| Sheath layer | Material | | PFA | PFA |
| Continuity test (Presence or absence of continuity) | Number of torsions | 1,000 | Present | Present |
| | | 2,000 | Present | Present |
| | | 3,000 | Present | Present |
| | | 4,000 | Present | Present |
| | | 5,000 | Present | Present |
| | | 10,000 | Present | Absent |

HIGH FREQUENCY CABLE COMPRISING A CENTER CONDUCTOR HAVING A FIRST WIRE STRANDED BY PLURAL SECOND WIRES THAT PROVIDE CORNERS FREE OF GAPS

CROSS-REFERENCE TO RELATED APPLICATION

The present application is based on Japanese patent application No. 2018-122821 filed on Jun. 28, 2018, the entire contents of which are incorporated herein by reference.

BACKGROUND OF THE INVENTION

1. Field of the Invention

The present invention relates to a high frequency cable.

2. Description of the Related Art

As a cable for high frequency signal transmission, there is, e.g., a flexible coaxial cable with a center conductor configured as a stranded member formed by stranding a plurality of conductor wires together and compressed so that voids between the center conductor wire and the surrounding conductor wires are substantially filled with a material for the conductor wires (See JP-561-45512 A).

[Patent Document 1]

SUMMARY OF THE INVENTION

In the cable described in JP-561-45512 A, however, gap formation (hereinafter, also referred to as "depression formation") occurs on an outer peripheral surface of the center conductor between the adjacent stranded wires, which may lead to a degradation in electrical properties of the cable. In the high frequency cable used in high frequency signal transmission, this electrical property degradation resulting from the depression formation then becomes much more pronounced.

Accordingly, it is an object of the present invention to provide a high frequency cable with improved electrical property degradation in high frequency signal transmission.

For the purpose of solving the above-described problem, the present invention provides high frequency cables defined by [1], [2], [3], and [4] below.

[1] A high frequency cable, including a center conductor comprising one first wire, which is located at the center of the center conductor, and a plurality of second wires, which are located around that one first wire, the one first wire and the plurality of second wires being stranded together, in which respective outer peripheral surfaces of the plurality of second wires constitute a substantially continuous circular peripheral surface as an outer peripheral surface of the center conductor.

[2] The high frequency cable as defined in [1] above, wherein the one first wire has a substantially hexagonal shape cross section, in which the plurality of second wires are configured as six second wires each having a substantially fan-shaped cross section surrounded by one circular arc, one base, and two lateral sides joining the one circular arc and the one base at their respective ends thereof, in which, in a transverse cross section view thereof, the bases of the substantially fan-shaped cross sections of the six second wires are contiguous with respective sides, of the substantially hexagonal shape cross section of the one first wire, while the lateral sides of the substantially fan-shaped cross sections of the six second wires are contiguous with respective lateral sides of the substantially fan-shaped cross sections of adjacent second wires, with the circular arcs of the substantially fan-shaped cross sections of the six second wires constituting the substantially continuous circular peripheral surface as the outer peripheral surface of the center conductor.

[3] The high frequency cable as defined in [1] or [2] above, wherein the center conductor is elongated by of 10% or more.

[4] The high frequency cable as defined in any one of [1] to [3] above, wherein, of the plurality of second wires, the adjacent second wires in a circumferential direction of the center conductor are separately in contact with each other.

Points of the Invention

According to the present invention, it is possible to provide the high frequency cables with improved electrical property degradation in high frequency signal transmission.

BRIEF DESCRIPTION OF THE DRAWINGS

FIG. 2 is a table showing one example of test results on electrical properties for an example of the present invention and a conventional example;

FIG. 4 is a table showing one example of test results on durability against external forces for the example of the present invention and the conventional example.

DETAILED DESCRIPTION OF THE PREFERRED EMBODIMENT

Embodiment

Figure 1:
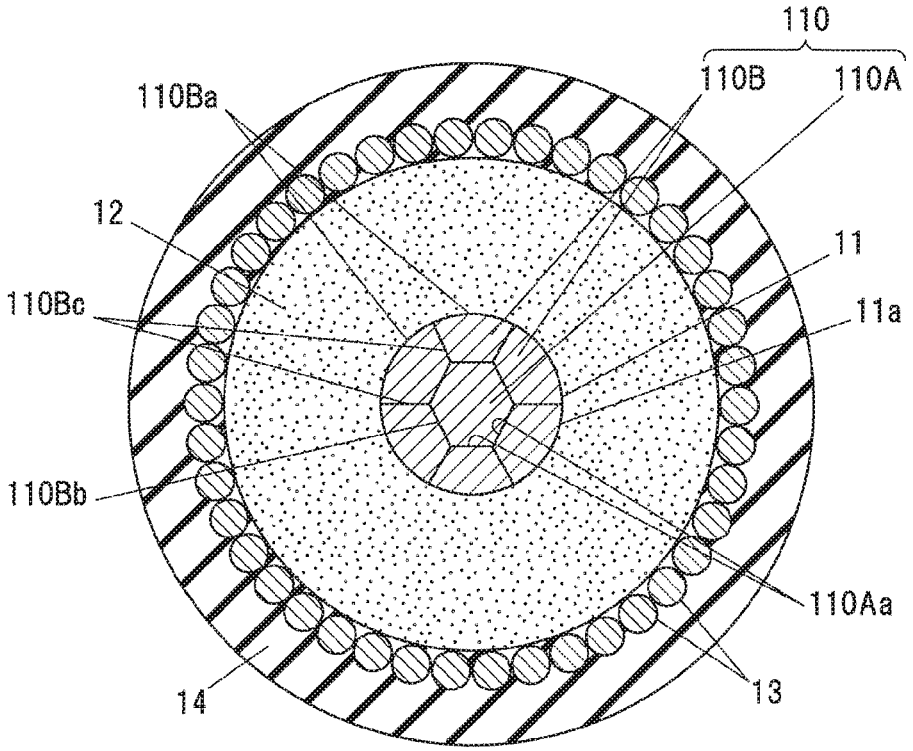
FIG. 1 is a cross-sectional view showing one example of a structure of a high frequency cable according to an embodiment of the present invention.

FIG. 1 is a transverse cross section view showing one example of a structure of a high frequency cable according to an embodiment of the present invention. As one example of the high frequency cable, a coaxial cable with each constituent layer thereof in a coaxial arrangement will be described below. As shown in FIG. 1, the high frequency cable is configured to include a center conductor 11, an insulating layer 12, which is provided around an outer periphery of the center conductor 11, outer conductors 13, which are provided around an outer periphery of the insulating layer 12, and an outermost sheath layer 14, which is provided around an outer side of the outer conductors 13.

(Center Conductor 11)

The center conductor 11 is configured to include a stranded wire formed by stranding a plurality of wires 110 together. The number of wires 110 to be stranded together is not particularly limited, but is preferably seven, or nineteen, or thirty seven, for example. Further, the plurality of wires 110 are more preferably configured to be concentrically stranded together with one of the plurality of wires 110 being located at the center of the center conductor 11, and the other wires being arranged in circumferentially equally divided positions, respectively, of the center conductor 11. Note that in FIG. 1, there is shown the configuration example with seven wires 110 being stranded together.

For the wires 110, e.g. a soft copper wire may be used. The soft copper wire may be subjected to a plating such as silver (Ag) plating or the like. Specifically, for the wires 110, e.g., a copper wire such as a HiFC™ (registered trademark) conductor or the like may be used.

The wires 110 are preferably configured to be small in diameter, and specifically, the wires 110 are preferably configured to have a diameter of 0.065 to 0.070 mm. Further, the stranded wire of the center conductor 11 is configured to be able to have a pitch length of e.g. about 8.7±0.5 mm. Furthermore, the wires 110 are configured to elongate by 10% or more in a longitudinal direction of the wires 110.

The center conductor 11 is configured to include one wire 110 (hereinafter, also referred to as "core 110A"), which is located at the center of the center conductor 11 and a plurality of other wires 110 (hereinafter, also referred to as "surrounding wires 110B"), which are located around that core 110A. Further, respective outer peripheral surfaces 110Ba of the plurality of surrounding wires 110B on a side of the insulative layer 12 constitute an outer peripheral surface 11*a* of the center conductor 11. Note that in FIG. 1, there is shown the configuration example with the number of surrounding wires 110B being set at six, as one example. Here, the core 110A is shown as one example of a first wire. Further, the surrounding wires 110B are shown as one example of second wires.

The core 110A is configured to have a substantially hexagonal shape cross section. That is, the core 110A is configured to have a substantially hexagonal column shape.

Further, the surrounding wires 110B are each configured to have a substantially fan-shaped cross section surrounded by one circular arc, one base, which is located in a side of a core 110A of the center conductor 11 relative to that one circular are and opposite that one circular arc, and two lateral sides, which are joining the one circular arc and the one base at respective ends thereof. That is, the surrounding wires 110B are each configured to have a columnar shape surrounded by one outer peripheral surface 110Ba, which is located in a side of an insulating layer 12 of the center conductor 11 and formed of a circular peripheral shape curved surface, one bottom surface 110Bb, which is located in a side of a core 110A of the center conductor 11 and formed of a planar surface, and two lateral surfaces 110Bc, which are joining the one outer peripheral surface 110Ba and the one bottom surface 110Bb at respective ends thereof in a peripheral direction of the center conductor 11.

The six surrounding wires 110B are each being provided in such a manner as to be in surface contact with the core 110A. Specifically, the respective bottom surfaces 110Bb of the six surrounding wires 110B are provided in such a manner as to be in surface contact with the side surfaces 110Aa, respectively, of the substantially hexagonal column shape core 110A. In other words, in the transverse cross section view shown in FIG. 1, the respective constituent bases of the substantially fan-shaped cross sections of the six surrounding wires 110B are provided in such a manner as to be contiguous with the constituent sides, respectively, of the substantially hexagonal shape cross section of the core 110A.

The adjacent surrounding wires 110B in a circumferential direction of the center conductor 11 are provided in such a manner as to be separately in surface contact with each other. Here, the term "separately" means that the adjacent surrounding wires 110B in the circumferential direction of the center conductor 11 are not being joined to each other.

Specifically, the respective lateral surfaces 110Bc of adjacent ones of the surrounding wires 110B in the circumferential direction of the center conductor 11 are provided in such a manner as to be in surface contact with each other. In other words, in the transverse cross section view shown in FIG. 1, the constituent lateral sides of the substantially fan-shaped cross sections of the six surrounding wires 110B are provided in such a manner as to be contiguous with respective constituent lateral sides of the substantially fan-shaped cross sections of adjacent surrounding wires 110B. Such a configuration of the surrounding wires 110B results in preventing the occurrence of specified size gap formation (hereinafter, also referred to as "depression formation") at corners in a side of the insulating layer 12 between the adjacent surrounding wires 110B in the circumferential direction of the center conductor 11.

By being configured in the above described manner, as shown in FIG. 1, the surrounding wires 110B are constituting the substantially continuous circular peripheral surface as an outer peripheral surface 11*a* of the center conductor 11. That is, the center conductor 11 is configured to have a substantially circular columnar shape like one single-wire conductor. In other words, in the transverse cross section view shown in FIG. 1, the outer peripheral edge of the center conductor 11 is configured to have an irregularity-free substantially circular shape. Note that the term "irregularity-free" does not mean "no irregularity," but means that the size of the irregularity is suppressed to be less than a specified micro size. Such a shape of the outer peripheral edge of the center conductor 11 allows the distances between the outer peripheral surface 11*a* of the center conductor 11 and the outer conductors 13 in radial directions of the high frequency cable 1 to be held substantially constant regardless of peripheral directions of the center conductor 11.

Further, the center conductor 11 is configured to have an elongation of 10% or more in its longitudinal direction.

(Insulating Layer 12)

The insulating layer 12 is configured as a layer formed of an insulating material. The insulating layer 12 is formed of, for example, a fluorine resin. For the fluorine resin, for example, a tetrafluoroethylene/ethylene copolymer (ETFE), a tetrafluoroethylene/hexafluoropropylene copolymer (FEP), or a tetrafluoroethylene/perfluoroalkyl vinyl ether copolymer (PFA) is suitable. The insulating layer 12 is preferably configured to have a thickness of 0.20 to 0.22 mm (Outer Conductor 13)

The outer conductor 13 is configured as, e.g., a tin-plated (Sn-plated) soft copper wire, a tin-plated copper wire, a tin-plated copper alloy wire, a silver-plated (Ag-plated) copper wire, or a silver-plated copper alloy wire. A large number (e.g., 30 to 60) of the outer conductors 13 are wrapped in a helical arrangement at a specified pitch (for example, 9.7±1.0 mm) around the outer periphery of the insulating layer 12. The outer conductors 13 may be spirally wrapped (wrapped in a side by side arrangement), or in a meshed arrangement (also called "braided arrangement") around the outer periphery of the insulating layer 12. The outer conductors 13 are preferably configured to have an outer diameter of 0.70 to 0.73 mm (Sheath Layer 14)

The sheath layer 14 is formed by using a material such as, but not specially limited to, PVC (polyvinyl chloride), PE (polyethylene), FEP (e.g., a polymer such as TEFLON™), or the like. The sheath layer 14 may be configured as a single layer, or as multiple layers. Further, the sheath layer 14 may be provided with a separator, a braid, etc., if desired. The sheath layer 14 is preferably configured to have a thickness of 0.055 to 0.065 mm.

[Center Conductor 11 Producing Method]

Next, a center conductor 11 producing method will be described. The center conductor 11 producing method includes the steps of: forming a stranded wire by stranding a plurality of wires 110 together; compressing the stranded wires 110 to such a central direction that the stranded wire has a circular shape transverse cross section; and heating the compressed stranded wire.

The stranded wire compressing step results in deforming the transverse cross section of the one core 110A into a substantially hexagonal shape, while deforming the remaining six surrounding wires 110B into substantially fan shapes, respectively, as described previously. Further, this stranded wire compressing step results in bringing the six surrounding wires 110B into surface contact with each other, thereby preventing the occurrence of depression formation at corners in a side of the insulating layer 12 between the adjacent surrounding wires 110B in the circumferential direction of the center conductor 11. In other words, the stranded wire compressing step results in the six surrounding wires 110B forming the substantially circular columnar shape center conductor 11. Note that the wires 110 are strengthened by an increase in work hardening rate in the compression, but then subjected to the occurrence of compressive strains.

The compressed stranded wire heating step is performed in order to release the compressive strain energy caused in the stranded wire by the above-mentioned stranded wire compressing step. As the compressive strain energy stored in the stranded wire increases, the electrical properties of the stranded wire degrade. The heating step is performed to release this compressive strain energy and thereby recover the electrical properties of the stranded wire.

The compressed stranded wire heating step is performed by using, for example, a heating furnace (not shown) and the like. The compressed stranded wire (wires 110) may be subjected to thermal annealing at a specified temperature using an annealing furnace (not shown). The heating step results in recovering the electrical properties of the stranded wire (wires 110) up to about 98% of the electrical properties of a soft copper wire.

(Experimental Results 1)

The inventors conducted an experiment to compare the electrical properties for the high frequency cable 1 according to the above-described embodiment of the present invention (hereinafter also referred to as "the high frequency cable 1 according to the Example") and a high frequency cable according to a conventional example (hereinafter also referred to as "the high frequency cable according to the comparative example"). This experiment will be described below with reference to FIGS. 2 and 3.

FIG. 2 is a table showing one example of test results on electrical properties for the high frequency cable 1 according to the Example and the high frequency cable according to the comparative example. The inventors measured characteristic impedance, conductor resistance at 20° C., electrostatic capacitance at 1 KHz, and attenuation between 100 MHz and 40 GHz, as one example of indices for indicating the electrical properties. In these measurements, for the Example, the high frequency cable 1 including a center conductor having a circular columnar shape having a substantially continuous circular peripheral surface resulting from the compression in the above-described stranded wire compressing step was used. On the other hand, for the comparative example, the high frequency cable including a center conductor with depression formation occurring in the outer peripheral surface of the center conductor due to being not compressed was used. Note that the detailed conditions of the high frequency cable 1 used in the measurements are shown in FIG. 2 of the high frequency cable 1 with respect to a comparative example.

Figure 3:
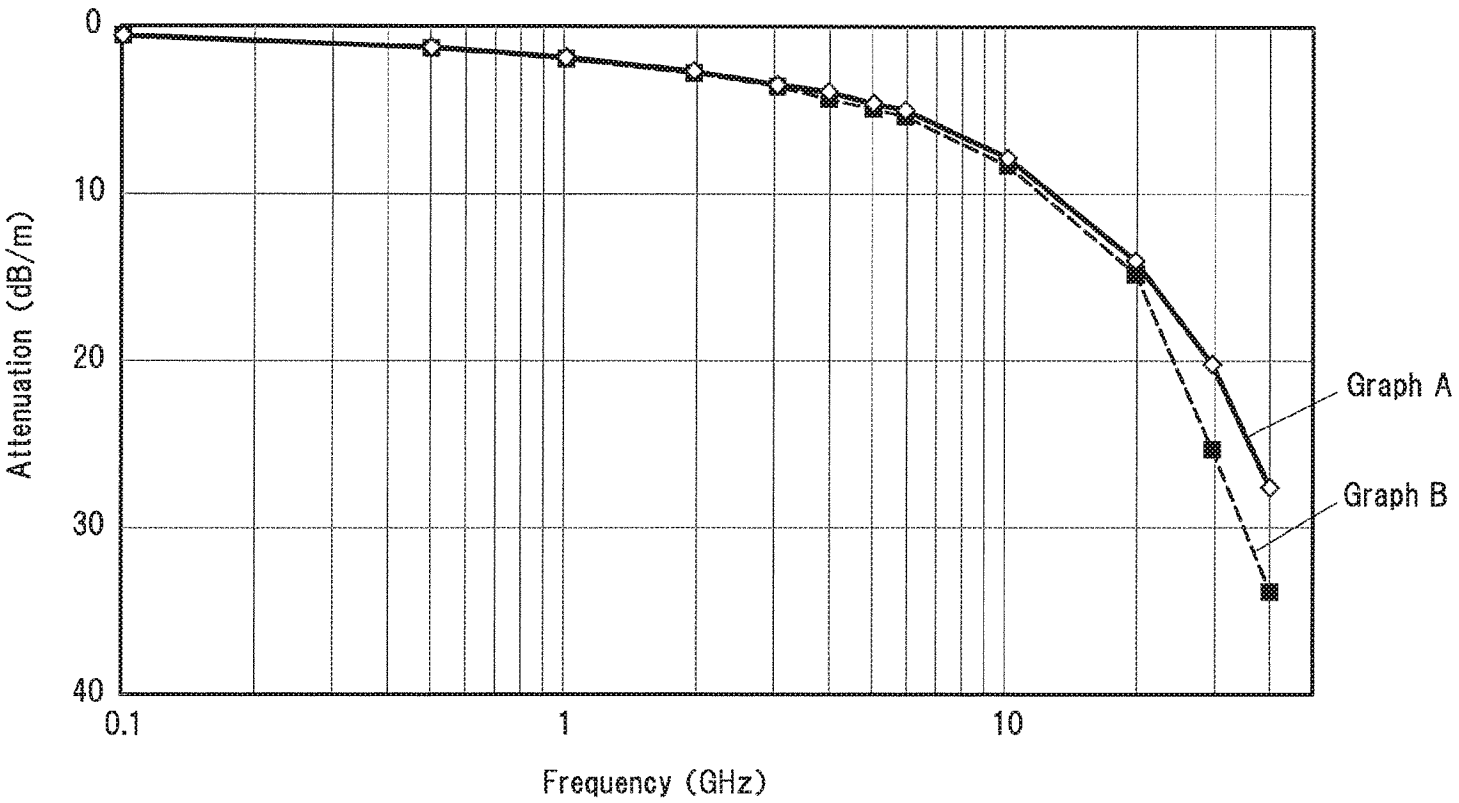
FIG. 3 is a diagram showing the results on attenuation shown in FIG. 2.

FIG. 3 is a diagram showing the results based on attenuation as shown in FIG. 2 for the high frequency cable 1 according to the Example and the high frequency cable according to the comparative example. The horizontal axis shows the frequency (GHz). The vertical axis shows the attenuation (dB/m). Here, the attenuation refers to the attenuation of a signal which occurred for a period of time for which that signal was input to one end of a unit length of the high frequency cable 1 and output from the other end thereof. Further, a graph A (solid line) shows the attenuation in the high frequency cable 1 according to the Example, while a graph B (broken line) shows the attenuation in the high frequency cable according to the comparative example.

As shown in FIG. 3, it was verified that the attenuation in the high frequency cable 1 according to the Example was smaller than the attenuation in the high frequency cable according to the comparative example, in a high frequency region (e.g., 3 GHz or higher).

(Experimental Results 2)

In addition, the inventors conducted an experiment to compare the durability against external forces, for the high frequency cable 1 according to the Example and the high frequency cable according to the comparative example. This experiment will be described below with reference to FIG. 4.

FIG. 4 is a table showing one example of test results on durability against external forces for the high frequency cable 1 according to the Example and the high frequency cable according to the comparative example. The results of a test (hereinafter, also referred to as "electrical continuity test") for checking the presence or absence of electrical continuity of the high frequency cable 1 when subjected to a specified number of torsions will be described below, as one example of indices for indicating the durability of the high frequency cable 1 against external forces. Note that the presence or absence of electrical continuity was checked by measuring the electrical resistance of the high frequency cable 1.

In the electrical continuity test, the high frequency cable 1 having a length of 20 mm and a weight of 50 g was subjected to alternate repetitions of 180 degree clockwise and counterclockwise torsions around a central shaft in its longitudinal direction. In addition, the torsions were performed at 30 cycles per minute. Note that the checking of the presence or absence of electrical continuity was performed by measuring the electrical resistance of the high frequency cable 1 immediately after performing the following specified numbers of torsions: 1,000, 2,000, 3,000, 4,000, 5,000 and 10,000.

As shown in FIG. 4, in the same manner as in the above-described electrical property testing, for the Example, the above-described high frequency cable 1 including a center conductor having a circular columnar shape having a substantially continuous circular peripheral surface was used, while, for the comparative example, the high frequency cable including a center conductor with depression formation occurring in its outer peripheral surface due to being not compressed was used. Note that, as shown in FIG. 4, the essential conditions other than the condition of the presence or absence of the stranded wire compressing step, specifically, the numbers of wires 110 constituting the center conductors 11, the materials for the center conductors 11, the materials for the insulating layers 12, the materials for the outer conductors 13, the materials for the sheath layers 14 and the like, as shown in FIG. 1, were the same in the Example and the comparative example.

As shown in FIG. 4, based on test results on durability against external forces for an example of the present invention and a comparative example having the same materials for the (i.e., Ag-plated) center conductor (i.e., 7-strand wires), insulating layer (i.e., FEP), outer conductor (i.e., Sn-plated soft copier), and sheath layer (i.e., PFA), it was verified by the results of the electrical continuity testing that the high frequency cable according to the comparative example had no electrical continuity (see "Absent" in FIG. 4) due to being subjected to the numbers of torsions of more than 5,000, while on the other hand, the high frequency cable 1 according to the Example had an electrical continuity (see "Present" in FIG. 4) even after being subjected to the numbers of torsions of at least 10,000.

(Applications)

The high frequency cable 1 according to the embodiment of the present invention described above is suitable for a cable to be mounted on a communication device such as a wireless device and the like, for example. Further, although the above embodiment has been described by using the coaxial cable as one example, the high frequency cable 1 may be applied to a multicore cable for a LAN (Local Area Network) and the like.

Operations and Advantageous Effects of the Embodiment

According to the embodiment of the present invention described above with respect to FIG. 1, since the respective outer peripheral surfaces 110Ba of the plurality of wires form the substantially continuous circular peripheral shape outer peripheral surface 11*a* of the center conductor 11, it is possible to provide the high frequency cable with improved electrical property degradation in high frequency signal transmission. In addition, since the high frequency cable includes the center conductor 11 formed by stranding the plurality of wires 110 together, it is possible to provide the high frequency cable excellent in the durability against external forces as well.

The reason for the enhancement in the electrical properties is considered to be that since the outer peripheral surfaces 110Ba of the plurality of surrounding wires 110B form the substantially continuous circular peripheral shape outer peripheral surface 11*a* of the center conductor 11, that is, the center conductor 11 has the circular columnar shape, the distances between the outer peripheral surface 11*a* of the center conductor 11 and the outer conductors 13 in the radial directions of the high frequency cable 1 are held substantially constant regardless of the peripheral directions of the center conductor 11 as in a single-wire conductor, resulting in good symmetric properties of an electric field and a magnetic field to be produced between the center conductor 11 and the outer conductors 13.

Although the embodiments of the present invention have been described above, the above described embodiments are not to be construed as limiting the inventions according to the claims. It should also be noted that not all combinations of the features described in the embodiments are indispensable to the means for solving the problem of the invention.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A high frequency cable including:

a center conductor comprising one first wire, which is located at a center of the center conductor, and a plurality of second wires, which are located around the one first wire, the one first wire and the plurality of second wires being stranded together; and an insulating layer provided around an outer periphery of the center conductor, wherein, in a side of the insulating layer, the center conductor includes corners that are free of gaps, between respective second wires located adjacent in a circumferential direction of the center conductor, and wherein the outer periphery of the center conductor includes respective outer peripheral surfaces of the plurality of second wires that constitute a substantially continuous circular peripheral surface.

2. The high frequency cable according to claim 1, wherein the one first wire has a substantially hexagonal shape cross section, wherein the plurality of second wires are configured as six second wires, each second wire having a substantially fan-shaped cross section that is defined by one circular arc, one base, and two lateral sides joining the one circular arc and the one base at respective two ends thereof, wherein, in a transverse cross section view thereof, the respective bases of the substantially fan-shaped cross sections of the six second wires are contiguous with corresponding sides of the one first wire of the substantially hexagonal shape cross section of the one first wire, while the lateral sides of the substantially fan-shaped cross sections of the six second wires are contiguous with respective lateral sides of the substantially fan-shaped cross sections of adjacent second wires, with the circular arcs of the substantially fan-shaped cross sections of the six second wires constituting the substantially continuous circular peripheral surface of the center conductor.

3. The high frequency cable according to claim 2, wherein, of the plurality of second wires, the adjacent second wires in the circumferential direction of the center conductor are separately in contact with each other.

4. The high frequency cable according to claim 1, wherein, in a radial direction of the high frequency cable, a distance between the substantially continuous circular peripheral surface and an outer surface of the insulating layer is constant.

5. The high frequency cable according to claim 1, wherein, of the plurality of second wires, the adjacent second wires in the circumferential direction of the center conductor are separately in contact with each other.

6. The high frequency cable according to claim 1, wherein, in a radial direction of the high frequency cable, throughout an entirety of the outer periphery of the center conductor, a distance between the substantially continuous circular peripheral surface and an outer surface of the insulating layer is constant.

7. The high frequency cable according to claim 1, wherein, in a radial direction of the high frequency cable, a distance between the outer periphery of the center conductor and an outer surface of the insulating layer is constant.

8. The high frequency cable according to claim 1, wherein the insulating layer is disposed on the outer periphery of the center conductor.

9. The high frequency cable according to claim 1, wherein the C insulating layer abuts the outer periphery of the center conductor.

10. The high frequency cable according to claim 1, wherein the insulating layer is disposed on the outer peripheral surfaces of the plurality of second wires.

11. The high frequency cable according to claim 1, wherein the insulating layer abuts the outer peripheral surfaces of the plurality of second wires.

12. The high frequency cable according to claim 1, wherein the insulating layer is disposed on the substantially continuous circular peripheral surface.

13. The high frequency cable according to claim 1, wherein the substantially continuous circular peripheral surface completely encircles the one first wire.

14. The high frequency cable according to claim 1, wherein, throughout the circumferential direction of the center conductor, a distance between the substantially continuous circular peripheral surface and an outer surface of the insulating layer is constant.

15. The high frequency cable according to claim 1, wherein, throughout the circumferential direction of the center conductor, a distance between the outer periphery of the center conductor and an outer surface of the insulating layer is constant.

16. The high frequency cable according to claim 1, wherein, in a radial direction of the high frequency cable, throughout an entirety of the outer periphery of the center conductor, a distance between the outer periphery of the center conductor and an outer surface of the insulating layer is constant.

* * * * *